US011206479B2

(12) United States Patent
Fujimori et al.

(10) Patent No.: US 11,206,479 B2
(45) Date of Patent: Dec. 21, 2021

(54) SPEAKER DEVICE AND SPEAKER CABINET

(71) Applicant: YAMAHA CORPORATION, Hamamatsu (JP)

(72) Inventors: Hiroki Fujimori, Hamamatsu (JP); Kenta Ioku, Hamamatsu (JP)

(73) Assignee: YAMAHA CORPORATION, Hamamatsu (JP)

( * ) Notice: Subject to any disclaimer, the term of this patent is extended or adjusted under 35 U.S.C. 154(b) by 284 days.

(21) Appl. No.: 16/449,938

(22) Filed: Jun. 24, 2019

(65) Prior Publication Data

US 2019/0313181 A1 Oct. 10, 2019

Related U.S. Application Data

(63) Continuation of application No. PCT/JP2017/045518, filed on Dec. 19, 2017.

(30) Foreign Application Priority Data

Dec. 28, 2016 (JP) ..... JP2016-257140

(51) Int. Cl.
*H04R 1/28* (2006.01)
*H04R 1/02* (2006.01)

(52) U.S. Cl.
CPC ..... *H04R 1/2815* (2013.01); *H04R 1/02* (2013.01)

(58) Field of Classification Search
CPC .. H04R 1/2815; H04R 1/2819; H04R 1/2823; H04R 1/2826; H04R 1/02
USPC ..... 181/156, 191
See application file for complete search history.

(56) References Cited

U.S. PATENT DOCUMENTS 2,866,513 A * 12/1958 White ..... H04R 1/2865 181/156
2,971,598 A * 2/1961 Jerome ..... H04R 1/2865 181/152
2,986,229 A * 5/1961 Perkins, Jr. ..... H04R 1/2865 181/199

(Continued)

FOREIGN PATENT DOCUMENTS

CN 201114729 Y 9/2008
CN 201995111 U 9/2011

(Continued)

OTHER PUBLICATIONS

International Search Report issued in Intl. Appln. No. PCT/JP2017/045518 dated Mar. 6, 2018. English translation provided.

(Continued)

*Primary Examiner* — Jeremy A Luks
(74) *Attorney, Agent, or Firm* — Rossi, Kimms & McDowell LLP

(57) ABSTRACT

Provided is a speaker device, including: a speaker unit; and a speaker cabinet to which the speaker unit is mounted. The speaker cabinet includes an outer plate; and a partition plate arranged between the outer plate and the speaker unit so as to be opposed to the outer plate. The outer plate and the partition plate form a bass reflex port communicating with a rear space of the speaker unit, and the partition plate includes a leading end surface inclined so as to gradually increase a distance from the outer plate as extending forward.

8 Claims, 8 Drawing Sheets

(56) References Cited

U.S. PATENT DOCUMENTS

| | | | | | |
|---|---|---|---|---|---|
| 3,729,061 | A * | 4/1973 | Tamura | H04R 1/26 | 181/146 |
| 3,730,291 | A * | 5/1973 | Goeckel | H04R 1/2865 | 181/193 |
| 4,284,166 | A * | 8/1981 | Gale | H04R 1/2826 | 181/156 |
| 4,524,846 | A * | 6/1985 | Whitby | H04R 1/30 | 181/147 |
| 4,592,444 | A * | 6/1986 | Perrigo | H04R 1/2865 | 181/151 |
| 4,807,293 | A * | 2/1989 | Weckler | H04R 1/2865 | 181/152 |
| 4,853,964 | A * | 8/1989 | Weckler | H04R 1/2865 | 381/341 |
| 5,109,422 | A | 4/1992 | Furukawa | | |
| 5,111,905 | A | 5/1992 | Rodgers | | |
| 5,436,977 | A * | 7/1995 | Sato | H04R 1/2826 | 181/156 |
| 5,623,132 | A * | 4/1997 | Gahm | H04R 1/2826 | 181/156 |
| 6,349,792 | B1 * | 2/2002 | Smith, Jr | H04R 1/345 | 181/152 |
| 7,162,049 | B2 | 1/2007 | Polk, Jr. | | |
| 8,256,566 | B1 * | 9/2012 | Rodgers | H04R 1/2826 | 181/156 |
| 8,327,974 | B1 * | 12/2012 | Smith, Jr | H04R 1/345 | 181/175 |
| 8,391,528 | B2 * | 3/2013 | Vercelli | H04R 1/2826 | 381/349 |
| 9,241,211 | B2 * | 1/2016 | Miki | H04R 1/2826 | |
| 9,615,155 | B2 | 4/2017 | Yoshida | | |
| 9,635,454 | B2 * | 4/2017 | Larrieu | H04R 1/2826 | |
| 10,645,484 | B2 * | 5/2020 | Kwolek | H04R 1/028 | |
| 10,904,650 | B2 * | 1/2021 | Fujimori | H04R 1/02 | |
| 2005/0047623 | A1 | 3/2005 | Graber | | |
| 2007/0116313 | A1 * | 5/2007 | Seagrove | H04R 1/2857 | 381/337 |
| 2009/0173567 | A1 * | 7/2009 | Stiles | H04R 1/2849 | 181/148 |
| 2015/0222984 | A1 | 8/2015 | Larrieu | | |
| 2019/0238975 | A1 * | 8/2019 | Dalmas, II | F02M 61/08 | |
| 2019/0281382 | A1 * | 9/2019 | Sahyoun | H04R 1/2834 | |

FOREIGN PATENT DOCUMENTS

| | | | |
|---|---|---|---|
| CN | 103491465 | A | 1/2014 |
| CN | 203933920 | U | 11/2014 |
| CN | 204465835 | U | 7/2015 |
| CN | 205693872 | U | 11/2016 |
| JP | H0247893 | U | 4/1990 |
| JP | H10191486 | A | 7/1998 |
| JP | 2005354396 | A | 12/2005 |
| JP | 2012191606 | A | 10/2012 |
| JP | 2014179931 | A | 9/2014 |

OTHER PUBLICATIONS

Written Opinion issued in Intl. Appln. No. PCT/JP2017/045518 dated Mar. 6, 2018.

English translation of Written Opinion issued in Intl. Appln. No. PCT/JP2017/045518 dated Mar. 6, 2018, previously cited in IDS filed Jun. 24, 2019.

International Preliminary Report on Patentability issued in Intl. Appln. No. PCT/JP2017/045518 dated Jul. 11, 2019. English translation provided.

Office Action issued in Chinese Appln. No. 201780080484.7 dated Jan. 6, 2020. English translation provided.

Office Action issued in Chinese Appln. No. 201780080484.7 dated Oct. 10, 2020. English translation provided.

Office Action issued in Japanese Appln. No. 2016-257140 dated Nov. 10, 2020. English computer generated translation provided.

Extended European Search Report issued in European Appln. No. 17887030.9 dated Jun. 18, 2020.

Office Action issued in Chinese Appln. No. 201780080484.7 dated Apr. 2, 2021. Partial English translation provided.

* cited by examiner

SPEAKER DEVICE AND SPEAKER CABINET

CROSS-REFERENCE TO RELATED APPLICATION

The present application is continuation of International Application No. PCT/JP2017/045518 filed on Dec. 19, 2017, which claims priority from Japanese Application No. JP 2016-257140 filed on Dec. 28, 2016. The contents of these applications are hereby incorporated by reference into this application.

TECHNICAL FIELD

The present invention relates to a speaker device having a bass reflex port, and a speaker cabinet.

BACKGROUND ART

Hitherto, there has been known a speaker device having a bass reflex port formed in a speaker cabinet in order to boost bass. For the bass reflex port, it is effective to, for example, reduce a sectional area of the bass reflex port in order to lower a resonance frequency and increase efficiency of boosting bass. In this case, a flow of the air is increased in speed so that wind noise may be generated from an opening portion of the port. Therefore, a countermeasure against the problem is required.

For example, in Patent Literature 1, a speaker device having a bass reflex port is disclosed. In the speaker device, a tubular bass reflex port is placed on aside of a speaker unit in a speaker cabinet. A cross section of the bass reflex port is circular. In order to prevent generation of the wind noise, at the opening portion of the bass reflex port, a flared portion is formed to have a sectional area exponentially increasing toward the opening.

CITATION LIST

Patent Literature

[PTL 1] JP 2005-354396 A

SUMMARY OF INVENTION

Technical Problem

However, in the speaker device disclosed in Patent Literature 1, in order to form the exponential shape, a large space is required around the bass reflex port.

The present invention has been made in view of the above-mentioned circumstances, and has an object to prevent generation of wind noise and an unusual sound at an opening end of a bass reflex port while achieving downsizing of a speaker cabinet.

Solution to Problem

According to one embodiment of the present invention, a speaker device includes a speaker unit, and a speaker cabinet to which the speaker unit is mounted. A partition plate is arranged between an outer plate of the speaker cabinet and the speaker unit so as to be parallel to the outer plate, and a bass reflex port communicating with a rear space of the speaker unit is formed in an opposing region between the outer plate and the partition plate. A leading end surface of the partition plate at an opening end of the bass reflex port is formed of an inclined surface that is inclined from an inner side to an outer side of the bass reflex port so as to gradually increase a distance from the outer plate.

With the inclination of the leading end surface of the partition plate, a flow from the inside of the bass reflex port is smoothly spread. In this manner, generation of the wind noise and the unusual sound can be prevented. Further, the outer plate of the speaker cabinet is used for the bass reflex port, and the bass reflex port is formed in an interior opposing region between the outer plate and the partition plate. Accordingly, downsizing of the speaker cabinet can be achieved as compared to a case in which the bass reflex port is placed as an independent component.

In the speaker device according to the present invention, a grille plate is arranged in front of the speaker unit. The grille plate has holes configured to allow passage of a sound. At an end portion of the grille plate, an inclined portion without the holes is formed so as to be flush with the inclined surface of the partition plate.

With the grille plate, a wide range from the inclined surface of the partition plate to a surface of the inclined portion of the grille plate is provided as a flared structure. With the flared portion, flow control is performed, thereby being capable of enhancing a function of preventing generation of the wind noise and the unusual sound.

Further, when the speaker cabinet is produced by combining, for example, wooden boards and a region of a curved surface extending as the exponential shape of the bass reflex port is formed in the boards, a size of the curved surface depends on thicknesses of the boards. Accordingly, there is a limitation on enlargement of the shape of the bass reflex port, and an insufficient expansion of the opening portion of the bass reflex port causes generation of the wind noise and the unusual sound. Meanwhile, when the thicknesses of the boards defining the bass reflex port are increased through use of veneered plywood, an inclination of the flared portion of the opening portion can be increased, but it is required to increase a size of the speaker cabinet.

When, as in the present invention, the inclined portion is formed at the end portion of the grille plate and the inclination of the opening end of the bass reflex port is increased, a large flared portion can be formed at the opening end without increasing the size of the cabinet.

Moreover, in the speaker device according to the present invention, it is preferred that a leading end surface of the outer plate be formed of an inclined surface that is inclined from the inner side to the outer side of the bass reflex port so as to gradually increase a distance from the partition plate.

When both the leading end surface of the partition plate and the leading end surface of the outer plate, which correspond to the opening end of the bass reflex port, are formed of the inclined surfaces, the wind noise can be further reduced. This configuration is effective particularly when an outer surface of the outer plate of the cabinet, which forms the bass reflex port together with the partition plate, is placed in an open state of being held in no contact with a floor or a wall.

In the speaker device according to the present invention, the outer plate and the partition plate may be made of wood.

When the outer plate and the partition plate are made of wood, the outer plate and the partition plate of the cabinet are each formed of a flat plate. Accordingly, turbulence is easily caused particularly at the opening end of the bass reflex port. However, even when the outer plate and the partition plate are made of wood, through processing of the inclined surfaces, generation of the unusual sound can be effectively prevented.

According to one embodiment of the present invention, a speaker cabinet includes a box-like body including a baffle plate and a plurality of outer plates. A partition plate is arranged in the box-like body so as to be parallel to an outer plate arranged in a direction of crossing the baffle plate, and a bass reflex port communicating with a rear space of the baffle plate is formed in an opposing region between the partition plate and the outer plate that are parallel to each other. A leading end surface of the partition plate at an opening end of the bass reflex port is formed of an inclined surface that is inclined from the inner side to the outer side of the bass reflex port so as to gradually increase a distance from the partition plate.

Advantageous Effects of Invention

According to the present invention, the bass reflex port is formed through use of the outer plate of the speaker cabinet, thereby being capable of achieving downsizing of the speaker cabinet. The bass reflex port has an inclination, thereby being capable of preventing generation of the wind noise and the unusual sound.

DESCRIPTION OF EMBODIMENTS

Figure 1:
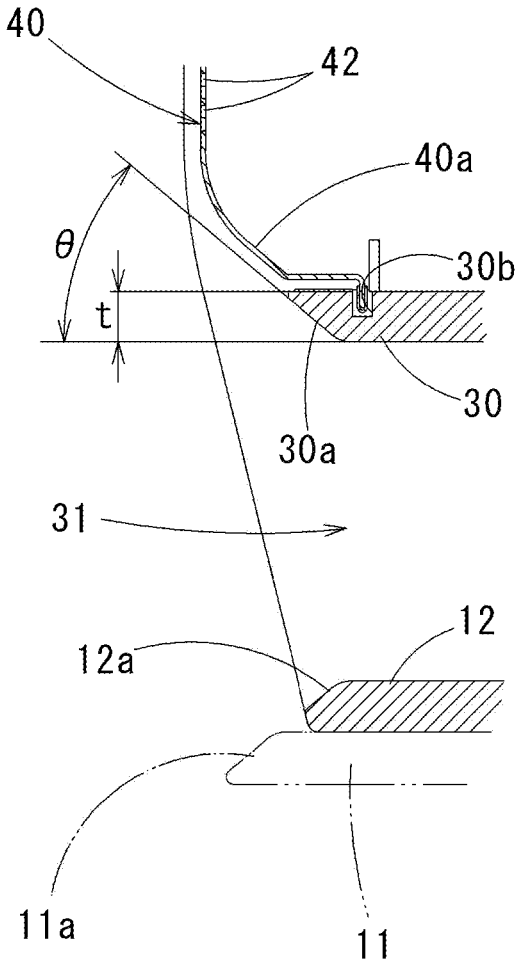
FIG. 1 is an enlarged vertical sectional view for illustrating a vicinity of an opening portion of a bass reflex port of a speaker device according to an embodiment of the present invention.

Now, a speaker device 1 according to an embodiment of the present invention is described. The speaker device 1 includes a speaker cabinet 10 and a speaker unit 20 mounted inside the speaker cabinet 10. In the following description, a front-and-rear direction, a right-and-left direction, and an up-and-down direction of the speaker device 1 are defined based on directions viewed from a front of the speaker device 1 in FIG. 2.

The speaker cabinet 10 includes a box-like body 17 having a substantially cuboid shape. The box-like body 17 includes a top plate 11 and a bottom plate 12 each having a rectangular shape, a baffle plate 13 being at a front, a pair of side plates 15 arranged on both sides of the baffle plate 13, and a back plate 16 arranged between rear portions of the side plates 15 to be parallel to the baffle plate 13. In the example illustrated in FIG. 2 and FIG. 4, the bottom plate 12 has a length in the front-and-rear direction smaller than that of the top plate 11.

Figure 3:
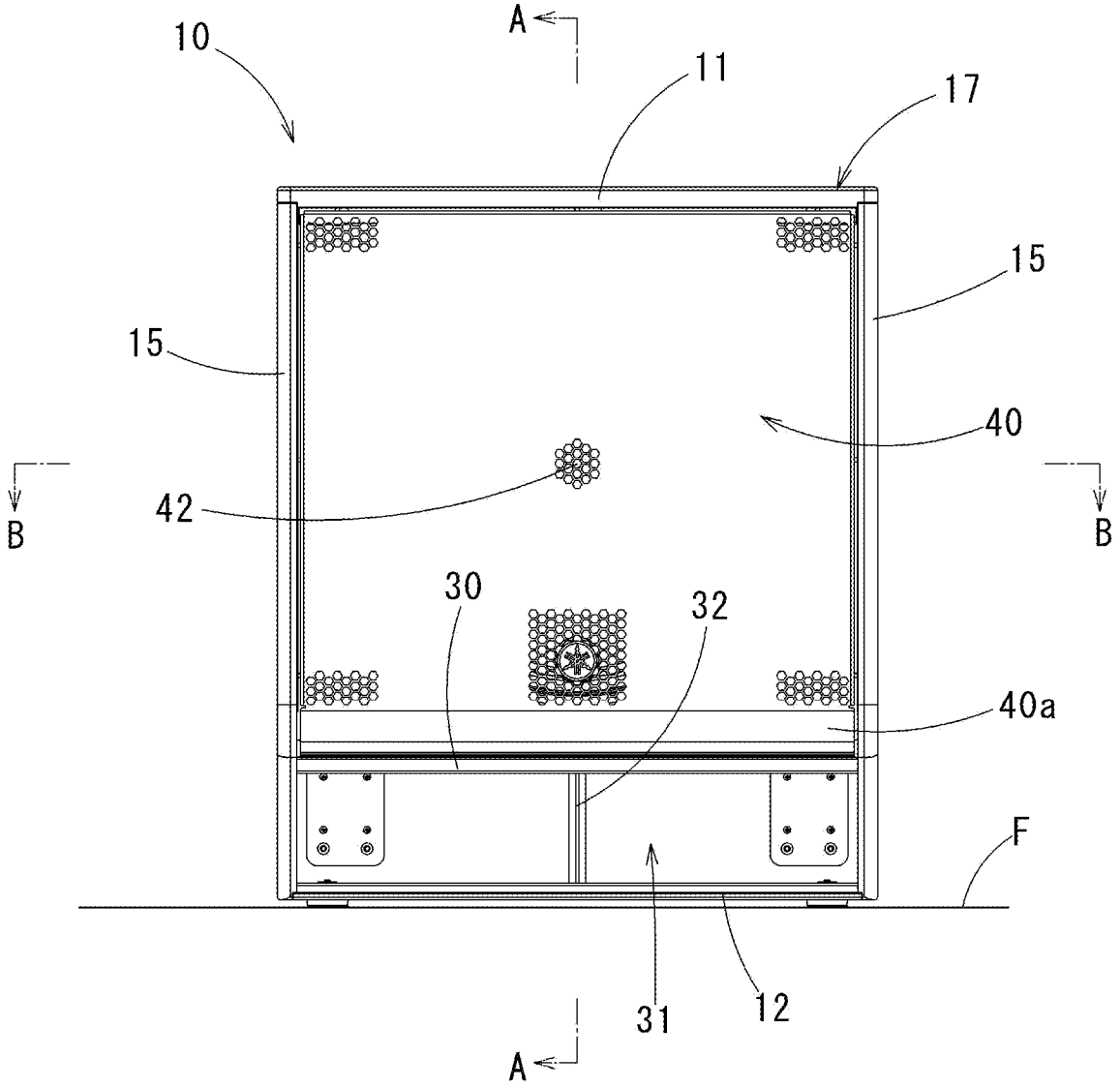
FIG. 3 is a front view for illustrating the speaker device of FIG. 2.
Figure 4:
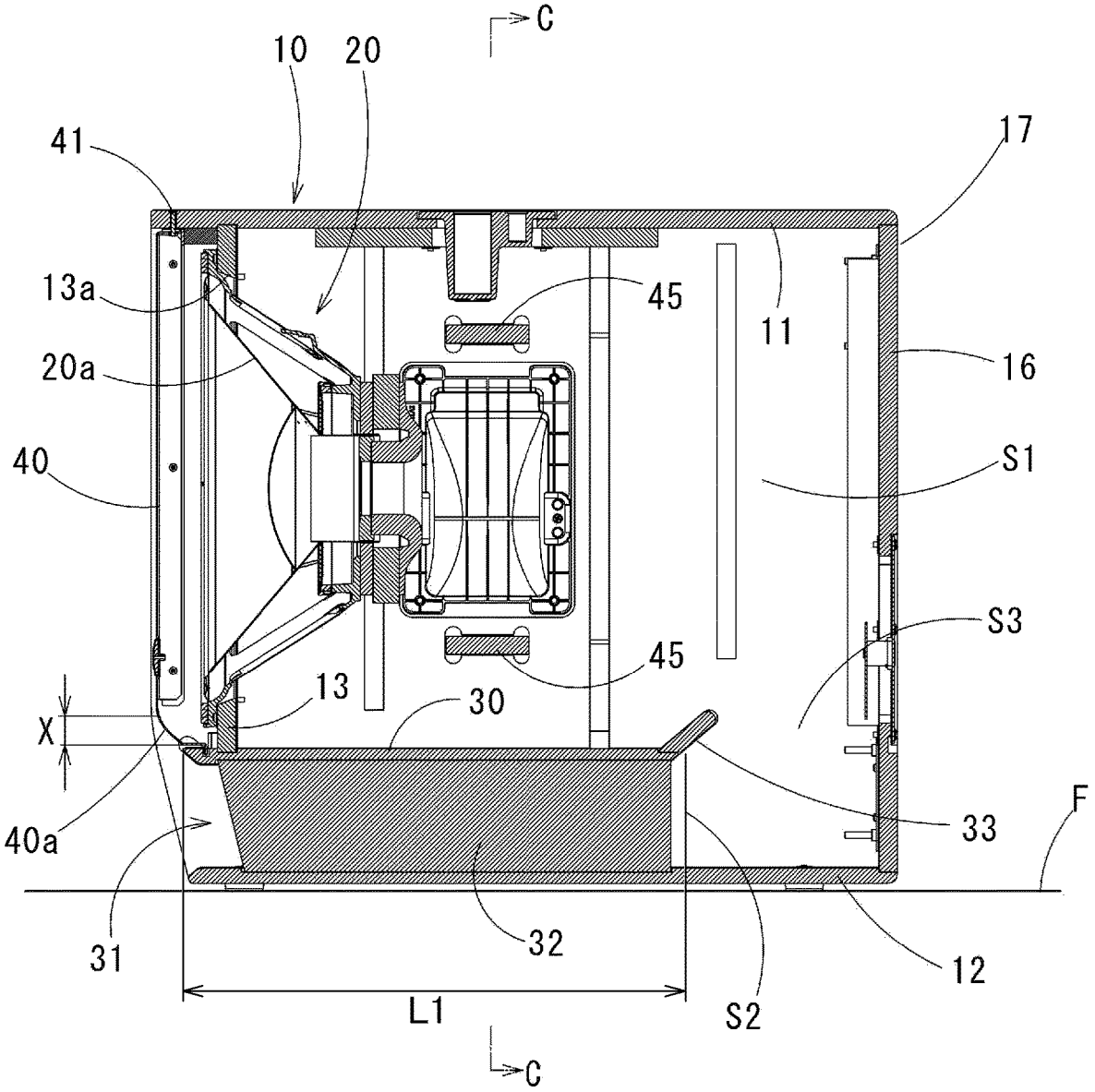
FIG. 4 is a vertical sectional view taken along the line A-A in FIG. 3.
Figure 5:
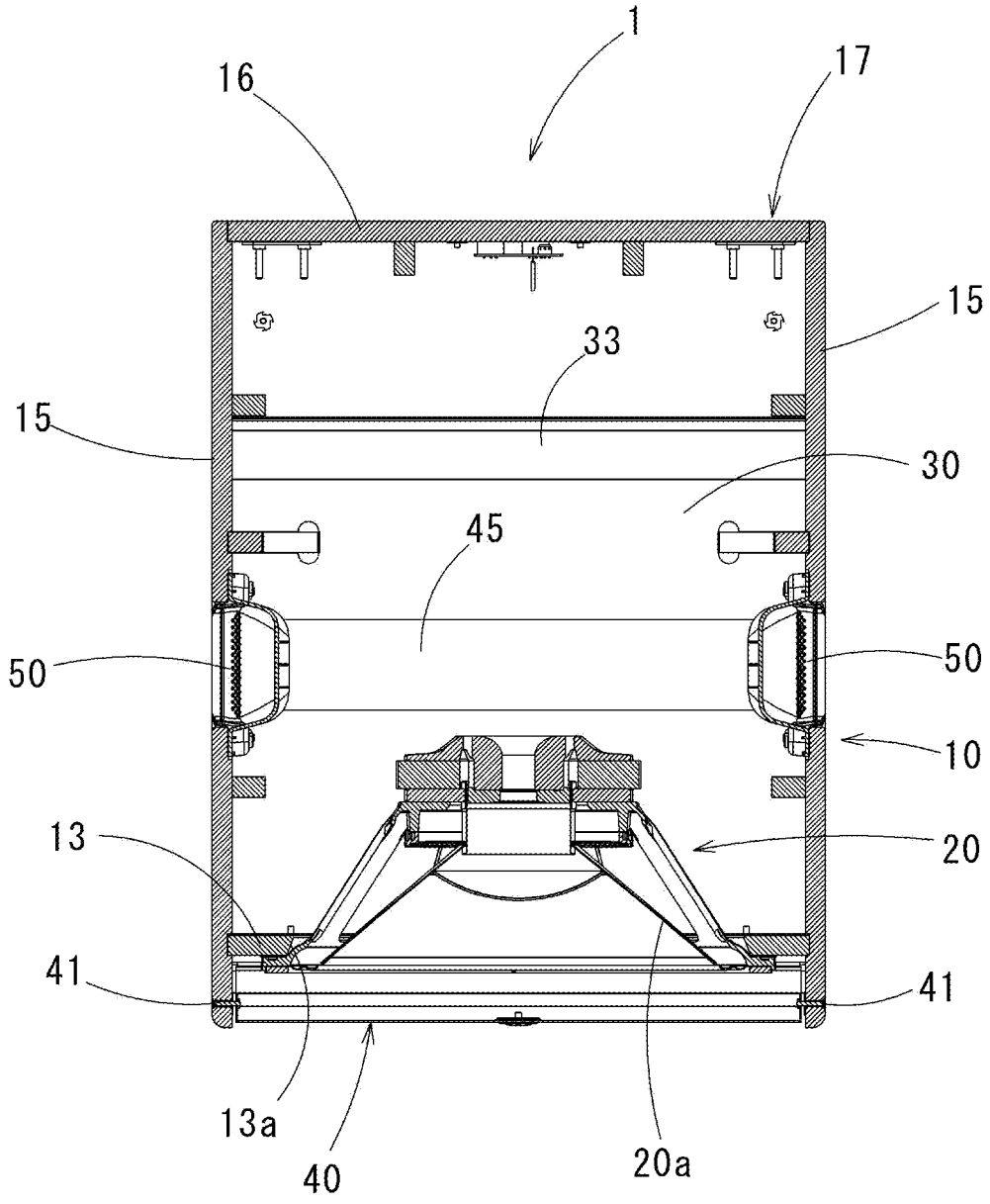
FIG. 5 is a transverse sectional view taken along the line B-B in FIG. 4.

In the example illustrated in FIG. 4 and FIG. 5, the speaker unit 20 includes a diaphragm 20*a* having a cone shape (conical shape), and the speaker unit 20 is fixed by a peripheral edge portion of an opening 13*a* formed in the baffle plate 13. With this configuration, the speaker unit 20 is mounted to the speaker cabinet 10 so that the diaphragm 20*a* is directed forward. The diaphragm 20*a* is vibrated through input of an audio signal so that the speaker unit 20 emits a sound wave forward (downward in FIG. 3) and emits a sound wave of an opposite phase rearward.

A partition plate 30 is arranged between the speaker unit 20 and the bottom plate 12 of the speaker cabinet 10 so as to be parallel to the bottom plate 12 (along the front-and-rear direction). The baffle plate 13 is arranged between a leading end portion of the partition plate 30 and a leading end portion of the top plate 11. Accordingly, a space between the bottom plate 12 and the partition plate 30 is opened forward.

Further, as illustrated in FIG. 4, a leading end of the partition plate 30 is substantially aligned with a leading end of the bottom plate 12 in the up-and-down direction. Meanwhile, the partition plate 30 has a predetermined length smaller than the length of the bottom plate 12 so that a rear end of the partition plate 30 is at an appropriate distance from the back plate 16. With this configuration, as illustrated in FIG. 4, a rear space S1 in the speaker unit 20 and a space S2 formed in an opposing region between the bottom plate 12 and the partition plate 30 communicate with each other through a space S3 formed between the rear end of the partition plate 30 and the back plate 16, and a bass reflex port 31 is formed in the space S2 between the bottom plate 12 and the partition plate 30.

Figure 6:
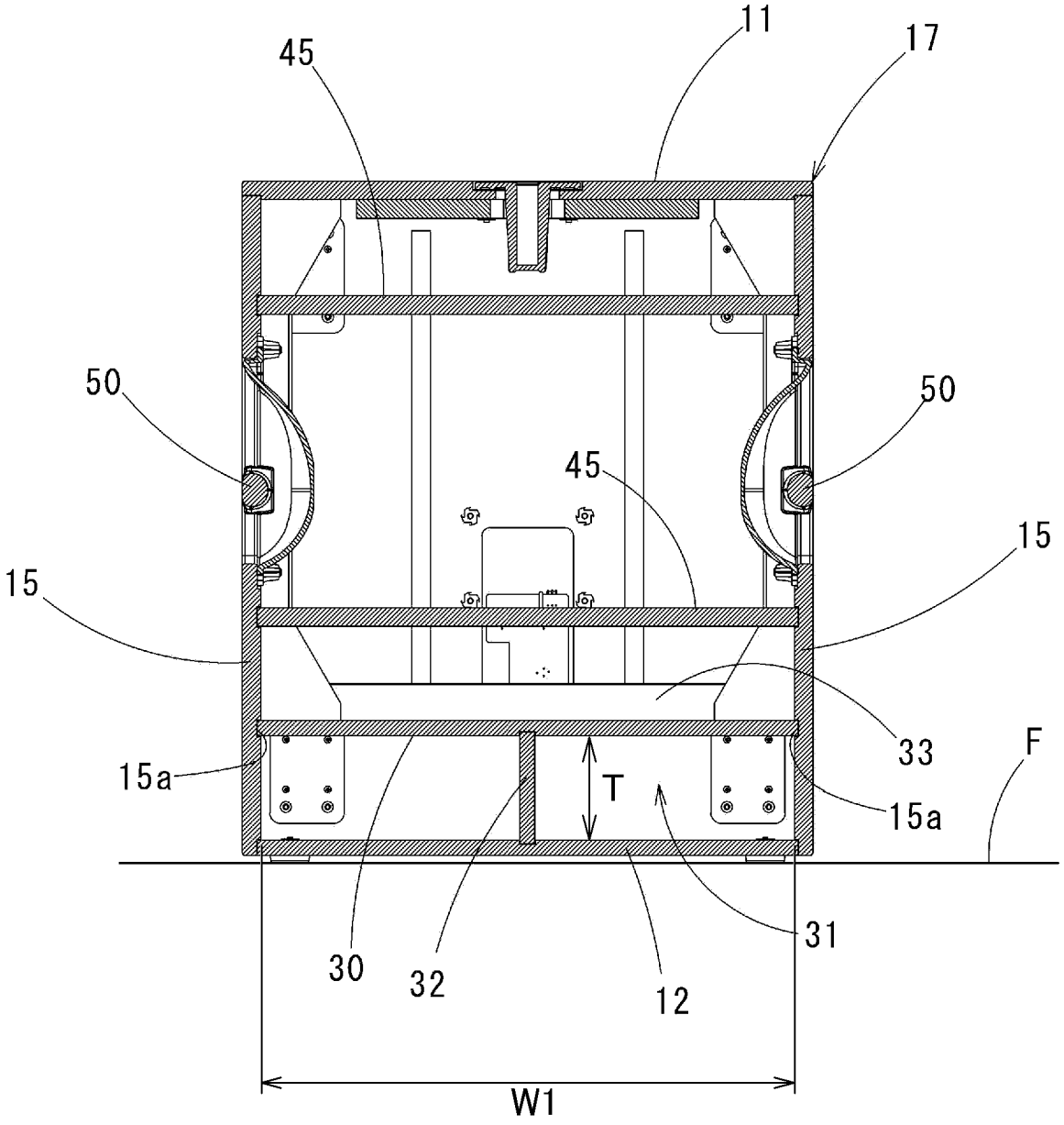
FIG. 6 is a vertical sectional view seen from a position different from that for FIG. 4, which corresponds to a cross section taken along the line C-C in FIG. 4.

As illustrated in FIG. 6, the partition plate 30 is fixed under a state in which both side portions of the partition plate 30 are fitted in grooves 15*a* formed, along the front-and-rear direction, in inner surfaces of both of the side plates 15. A support plate 32 is arranged substantially at a center of the partition plate 30 in a width direction thereof along the front-and-rear direction so as to connect the bottom plate 12 and the partition plate 30. Accordingly, the bass reflex port 31 is divided into right and left two regions by the support plate 32.

In a case of this embodiment, a distance between the side plates 15 corresponds to a width W1 of the bass reflex port 31, a distance between the partition plate 30 and the bottom plate 12 in the up-and-down direction corresponds to a thickness T of the bass reflex port 31, and a depth of the partition plate 30 (length in the front-and-rear direction) corresponds to a length L1 of the bass reflex port 31. The respective dimensions are not necessarily limited thereto.

Further, a guide plate 33 is mounted to the rear end of the partition plate 30 so as to be inclined obliquely upward as extending rearward. The guide plate 33 has an appropriate length along the width direction of the partition plate 30. The sound wave of the opposite phase from a back side of the speaker unit 20 is guided by the guide plate 33 into the bass reflex port 31.

The top plate 11, the bottom plate 12, the baffle plate 13, the side plates 15, and the back plate 16 forming outer plates of the box-like body 17, and the partition plate 30, the support plate 32, and the guide plate 33 forming the bass reflex port 31 are each made of wood. Those plates are each formed of, for example, a plywood board, a particle board, or a medium density fiberboard (MDF) so as to have an appropriate thickness.

A leading end surface of the partition plate 30 at an opening end of the bass reflex port 31 is formed of, throughout its full width, an inclined surface 30*a* that is inclined from the inner side to the outer side of the bass reflex port 31 so as to gradually increase a distance from the bottom plate 12. In this case, a thickness "t" of the partition plate 30 may be set equal to a thickness of each of the above-mentioned outer plates (the top plate 11, the bottom plate 12, the baffle plate 13, the side plates 15, and the back plate 16) of the box-like body 17, or may differ from the thickness of each of the outer plates. Further, an inclination angle θ of the inclined surface 30*a* at the leading end of the partition plate 30 with respect to a surface opposed to the bottom plate 12 is set as appropriate depending on, for example, a plate thickness of the partition plate 30 and the distance from the bottom plate 12.

Moreover, also a leading end surface of the bottom plate 12 of the box-like body 17, which is opposed to the partition plate 30, is formed of an inclined surface 12*a* that is inclined from the inner side to the outer side of the bass reflex port 30 so as to gradually increase a distance from the partition plate 30. The inclined surface 30*a* of the partition plate 30 and the inclined surface 12*a* of the bottom plate 12 are inclined substantially at the same inclination angle θ in opposite directions.

The inclined surface 30*a* of the partition plate 30 and the inclined surface 12*a* of the bottom plate 12 are each formed of a flat surface, but may be each formed of a smooth curved surface in which a center portion in a thickness direction of the partition plate 30 or the bottom plate 12 protrudes.

Meanwhile, in front of the speaker unit 20 and the baffle plate 13, a grille plate 40 having a rectangular shape in front view is mounted. The grille plate 40 is formed by, for example, bonding cloth on a surface of a metal plate such as steel. A lower end portion of the grille plate 40 is fitted in a groove 30*b* formed in an upper surface of the leading end portion of the partition plate 30. Both side portions and an upper end portion of the grille plate 40 are fixed to insides of front end portions of the side plates 15 and the top plate 11 with screws 41.

Further, a plurality of holes 42 are formed in a dotted manner in a surface of the grille plate 40 opposed to the diaphragm 20*a* of the speaker unit 20. The plurality of holes 42 are configured to allow passage of a sound emitted from the diaphragm 20*a*. At the lower end portion of the grille plate 40, an inclined portion 40*a* is formed so as to be flush with the inclined surface 30*a* of the partition plate 30 described above. The inclined portion 40*a* is formed across a full width of one side of the grille plate 40. The inclined portion 40*a* is formed so as to be flush with the inclined surface 30*a* of the partition plate 30 throughout the full width of the inclined portion 40*a*. In this case, the holes 42, which are formed in the portion opposed to the diaphragm 20*a*, are not formed in the inclined portion 40*a*.

It is preferred that a height X of the inclined portion 40*a* (see FIG. 4) be set so that the inclined portion 40*a* is prevented from overlapping the front of the diaphragm 20*a* of the speaker unit 20. However, the inclined portion 40*a* may be arranged to partially overlap the lower end portion of the diaphragm 20*a*.

Figure 7:
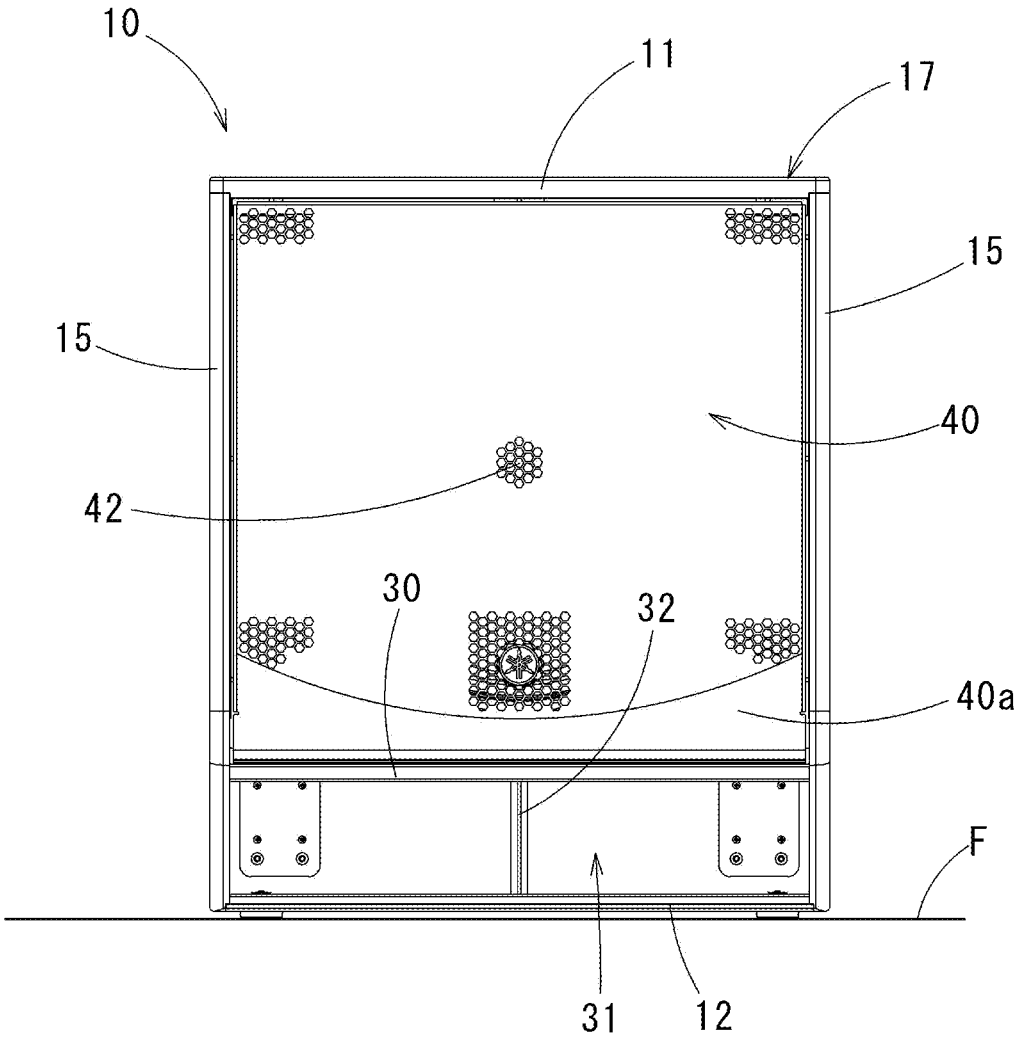
FIG. 7 is a front view for illustrating a modification example of a shape of an inclined portion in the speaker device according to the embodiment.

In the illustrated example, the inclined portion 40*a* is curved at the same inclination angle throughout the full width of the grille plate 40, and the height X of the inclined portion 40*a* is set to the same height throughout the full width. Meanwhile, the diaphragm 20*a* has a circular shape in front view. In conformity to this configuration, the height of the inclined portion 40*a* may be set small (set to about the height X illustrated in FIG. 4) at the center portion of the inclined portion 40*a* in the width direction, and at both side portions of the inclined portion 40*a* arranged obliquely below the diaphragm 20*a*, the height of the inclined portion 40*a* may be gradually increased (set larger than the height X illustrated in FIG. 4) outward so as to conform to a circular outer shape of the diaphragm 20*a*. In addition, the outer surface shape of the inclined portion 40*a* may have a suitable flat surface or curved surface as long as the inclined portion 40*a* is inclined substantially along an extension of the inclined surface 30*a* of the partition plate 30. For example, as illustrated in FIG. 7, the inclined portion 40*a* may be set so that the height of the inclined portion 40*a* is gradually increased from the center portion in the width direction toward the right-and-left direction.

Figure 2:
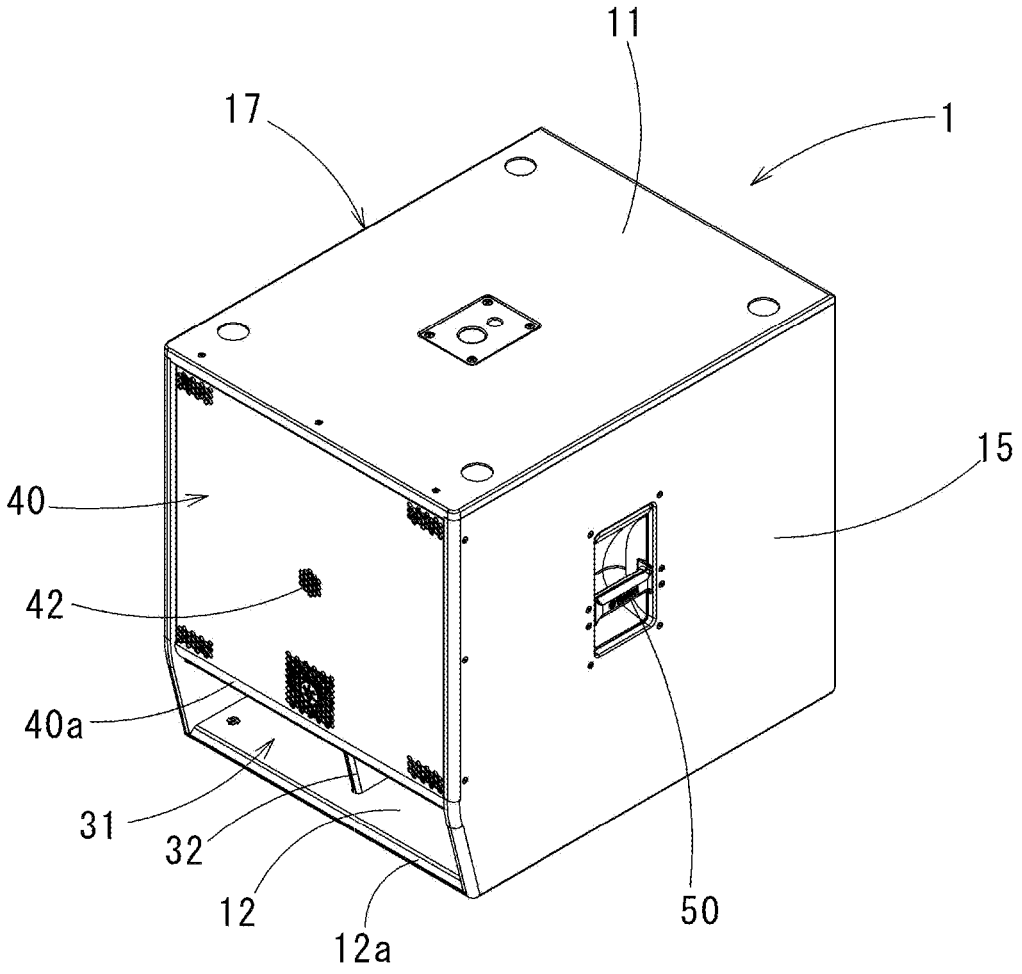
FIG. 2 is a perspective view for illustrating an overall external appearance of the speaker device according to the embodiment of the present invention.

In FIG. 4 and FIG. 5, reinforcing plates 45 are laid between the both side plates 15 of the box-like body 17. In FIG. 2 and FIG. 5, handle portions 50 are used for carrying the speaker device 1.

In the speaker device 1 configured as described above, when the diaphragm 20*a* is vibrated through input of the audio signal into the speaker unit 20, the sound wave is emitted to the front side of the speaker unit 20, and at the same time, the sound wave of the opposite phase is emitted also in the direction of the back of the diaphragm 20*a*. This sound wave is guided by the guide plate 33 to the rear end of the bass reflex port 31 to be released to the front side of the speaker cabinet 10 through the bass reflex port 31. At this time, at the opening end of the bass reflex port 31, the inclined surfaces 30*a* and 12*a* are formed at the leading end surface of the partition plate 30 and the leading end surface of the bottom plate 12, respectively, so as to be inclined from the inner side to the outer side of the bass reflex port 31. With this configuration, generation of a vortex is suppressed, thereby being capable of preventing generation of wind noise and an unusual sound.

Moreover, the inclined portion 40*a* is also formed in the grille plate 40 so as to be flush with the inclined surface 30*a* of the partition plate 30, and the inclined portion 40*a* and the inclined surface 30*a* form a long-flared shape. Thus, a function of preventing generation of the unusual sound can be enhanced.

Further, in the speaker device 1, the bass reflex port 31 is formed in the space S2 between the partition plate 30 and the bottom plate 12, and the leading end surface of the partition plate 30 and the leading end surface of the bottom plate 12 are respectively the inclined surfaces 30*a* and 12*a* that are formed into a flared shape. With this configuration, an installation space can be reduced as compared to a case in which the bass reflex port is formed of an independent tube as in Patent Literature 1, thereby being capable of achieving downsizing of the speaker cabinet 10. In particular, the bass reflex port 31 is formed between the bottom plate 12 and the partition plate 30, and hence the bass reflex port 31 having a large opening area can be provided while reducing an overall size of the box-like body 17 of the cabinet 10. Further, part of the grille plate 40 is formed into the inclined portion 40*a*, and the inclined portion 40*a* is formed so as to be inclined along the extension of the inclined surface 30*a* of the partition plate 30. Thus, without increasing the size of the box-like body 17, a large flared shape effective in preventing generation of the unusual sound can be provided.

The grille plate 40 has such a structure that the lower end portion is fitted into the groove 30*b* of the partition plate 30, and the upper end portion and the both side portions are fixed with screws. Thus, the grille plate 40 is easily mounted to and dismounted from the box-like body 17. Moreover, the inclined portion 40*a* forming the flared shape of the bass reflex port 31 is not fixed with screws. As a result, the inclined portion 40*a* can be inclined smoothly and continuously with the inclined surface 30*a* of the partition plate 30, and a proper flared shape can be formed.

The present invention is not limited to the above-mentioned embodiment, and various modifications can be made thereto without departing from the gist of the present invention.

For example, the bottom plate 12 of the speaker cabinet 10 is placed on a floor F, and hence the unusual sound is less liable to be generated. Accordingly, it is not always required that the leading end surface of the bottom plate 12 be formed into the inclined surface 12*a*.

Further, the bass reflex port 31 is formed throughout the full width of the box-like body 17. However, a partition plate may be arranged so as to be opposed to apart of the bottom plate 12 in the width direction so that a bass reflex port is formed in an opposing region between the partition plate and the bottom plate 12. A front of a lateral side of the bass reflex port may be closed.

Further, in the box-like body 17 of the speaker device 1 according to the embodiment, the length of the bottom plate 12 in the front-and-rear direction is smaller than the length of the top plate 11 in the front-and-rear direction (see FIG. 4). Accordingly, when two or more speaker devices 1 are used in a stacked state, the top plate 11 of the lower-level speaker device 1 protrudes forward with respect to the leading end of the bottom plate 12 of the upper-level speaker device 1. Therefore, as indicated by the two-dot chain lines in FIG. 1, when an inclined surface 11*a* is formed as a front end surface of the top plate 11 to be inclined downward from the rear side to the front side of the top plate 11, the inclined surface 12*a* of the bottom plate 12 of the bass reflex port 31 of the speaker device 1, which is stacked at the upper level, and the inclined surface 11*a* of the top plate 11 of the lower-level speaker device 1 are arranged so as to be flush with each other. In this manner, the flared shape of the bass reflex port 31 can be enlarged, and an effect of preventing generation of the unusual sound can be enhanced.

Moreover, in the embodiment, the partition plate 30 is arranged so as to be opposed to the bottom plate 12. However, for example, a partition plate may be arranged so as to be opposed to the side plate 15, and a bass reflex port may be formed in an opposing region between the partition plate and the side plate 15. In this case, when the speaker device is used under a state in which the side plate opposed to the partition plate is held in contact with a wall surface, the side plate and the wall surface have the same relationship as that defined between the bottom plate and the floor in the embodiment. Meanwhile, when the side plate is placed away from the wall, it is effective that, as a leading end surface of the side plate, an inclined surface is formed and inclined from the inner side to the outer side of the bass reflex port so as to gradually increase a distance from the partition plate.

Figure 8:
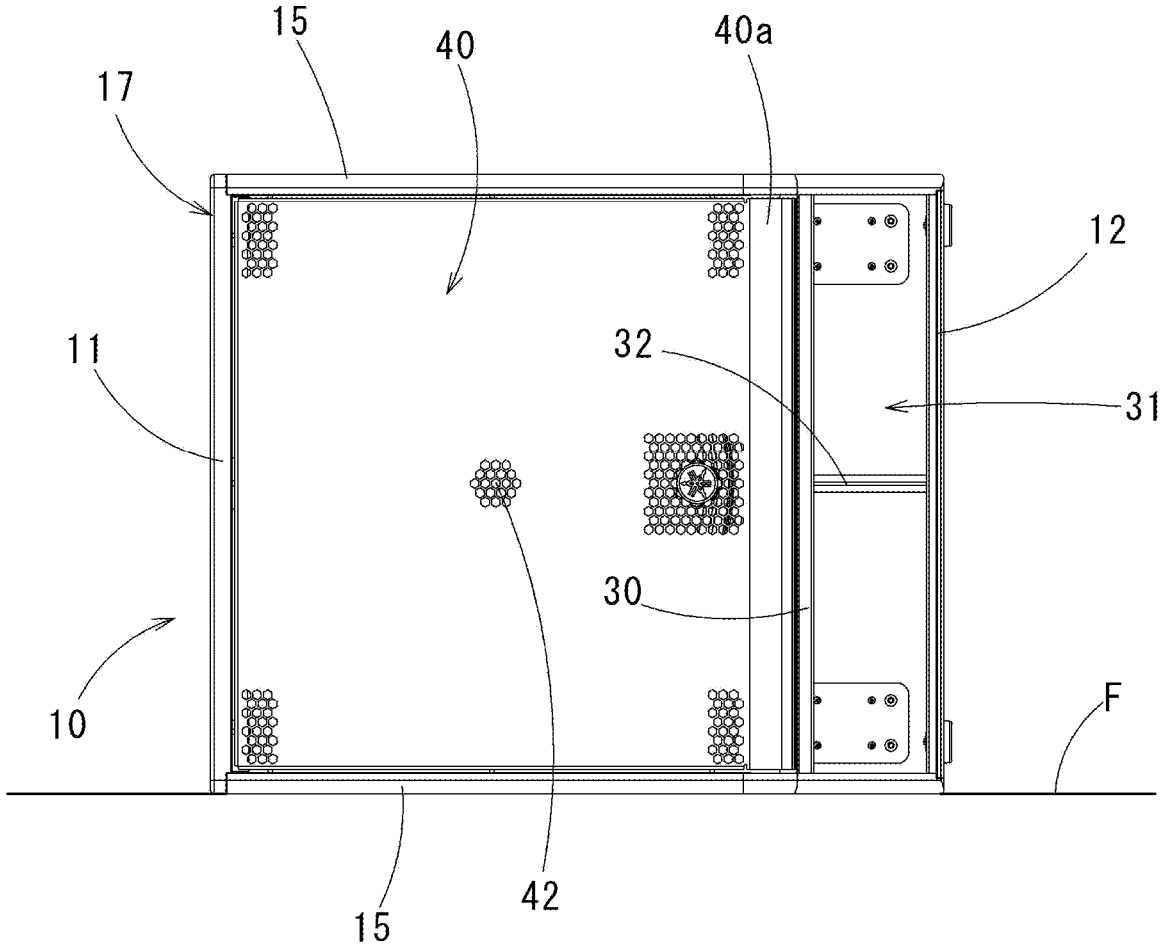
FIG. 8 is a front view for illustrating a laid posture of the speaker device according to the embodiment.

Further, as illustrated in FIG. 8, the speaker device 1 according to the embodiment may be used in a laid posture in which the side plate 15 is placed on the floor F. In this case, the bass reflex port 31 is arranged on the lateral side of the speaker unit.

In addition, a partition plate may be arranged so as to be opposed to the top plate of the box-like body, and a bass reflex port may be formed between the partition plate and the top plate. In the present invention, the outer plates of the box-like body, which are typified by the bottom plate, the side plates, and the top plate, refer to plate-like members forming an outer shape of the box-like body. In the present invention, the plate-like member forming the bass reflex port together with the partition plate is one of the outer plates.

The invention claimed is:

1. A speaker device comprising:
- a speaker unit; and
- a speaker cabinet to which the speaker unit is mounted, the speaker cabinet comprising:
  - an outer plate that forms a bottom plate of the speaker cabinet;
  - a partition plate arranged between the outer plate and the speaker unit; and
  - a top plate arranged opposing the partition plate and protruding forwardly with respect to the bottom plate,
  - wherein the partition plate is arranged opposing the outer plate,
  - wherein a front end surface of the top plate is inclined downwardly from a rear side to a front side of the top plate,
  - wherein the outer plate and the partition plate form a bass reflex port communicating with a rear space of the speaker unit, and
  - wherein the partition plate includes a first inclined leading end surface inclined upwardly from a rear side to a front side of the partition plate,
- wherein the speaker unit is arranged between top plate and the partition plate.

2. The speaker device according to claim 1, further comprising:
- a grille plate arranged in front of the speaker unit and including holes configured to allow passage of sound,
- wherein the grille plate includes, at an end portion thereof on a side of the partition plate, an inclined portion without the holes that extends along the first inclined leading end surface.

3. The speaker device according to claim 2, wherein an outer surface shape of the inclined portion includes a curved surface.

4. The speaker device according to claim 1, wherein the outer plate includes a second inclined leading end surface inclined downwardly from a rear side to a front side of the outer plate.

5. The speaker device according to claim 1, wherein the outer plate and the partition plate of the speaker cabinet are made of wood.

6. A speaker cabinet to which a speaker unit is mountable, the speaker cabinet comprising:
- an outer plate that forms a bottom plate of the speaker cabinet;
- a partition plate arranged between the outer plate and the speaker unit, in a state where the speaker unit is mounted to the speaker cabinet; and
- a top plate arranged opposing the partition plate and protruding forwardly with respect to the bottom plate,
- wherein the partition plate is arranged opposing the outer plate,
- wherein a front end surface of the top plate is inclined downwardly from a rear side to a front side of the top plate,
- wherein the partition plate and the outer plate form a bass reflex port communicating with a rear space of the speaker unit, in the state where the speaker unit is mounted to the speaker cabinet,
- wherein the partition plate includes an inclined leading end surface that is inclined upwardly from a rear side to a front side of the partition plate, and wherein the speaker unit, in the state where the speaker unit is mounted to the speaker cabinet, is arranged between the top plate and the partition plate.

7. The speaker cabinet according to claim 6, further comprising a box-shaped body defined by a plurality of outer plates, including the outer plate.

8. The speaker cabinet according to claim 7, wherein the outer plate is arranged in a direction of crossing the baffle plate.

* * * * *